US007749153B2

(12) United States Patent
Hamsund

(10) Patent No.: US 7,749,153 B2
(45) Date of Patent: Jul. 6, 2010

(54) INCUBATOR DEVICE

(76) Inventor: Torgeir Hamsund, Rosenkrantzg. 22, N-0160 Oslo (NO)

( * ) Notice: Subject to any disclaimer, the term of this patent is extended or adjusted under 35 U.S.C. 154(b) by 0 days.

(21) Appl. No.: 10/598,756

(22) PCT Filed: Mar. 7, 2005

(86) PCT No.: PCT/NO2005/000081

§ 371 (c)(1),
(2), (4) Date: Jun. 29, 2007

(87) PCT Pub. No.: WO2005/087170

PCT Pub. Date: Sep. 22, 2005

(65) Prior Publication Data

US 2008/0021261 A1 Jan. 24, 2008

(30) Foreign Application Priority Data

Mar. 11, 2004 (NO) ..... 20041045

(51) Int. Cl.
*A61G 11/00* (2006.01)

(52) U.S. Cl. ..... 600/22

(58) Field of Classification Search ..... 600/21–22
See application file for complete search history.

(56) References Cited

U.S. PATENT DOCUMENTS

| | | | | |
|---|---|---|---|---|
| 4,321,913 | A | 3/1982 | Maluta et al. | |
| 5,010,314 | A | 4/1991 | Estrov | |
| 5,392,020 | A | 2/1995 | Chang | |
| 5,707,337 | A | 1/1998 | Franz | |
| 6,409,654 | B1 * | 6/2002 | McClain | 600/22 |
| 6,418,932 | B2 * | 7/2002 | Paschal et al. | 128/845 |
| 6,641,521 | B2 * | 11/2003 | Kolarovic | 600/22 |
| 7,037,254 | B2 * | 5/2006 | O'Connor et al. | 600/21 |

FOREIGN PATENT DOCUMENTS

| | | |
|---|---|---|
| DE | 40 22 243 | 1/1992 |
| EP | 0 514 136 | 5/1992 |
| GB | 2 371 683 | 7/2002 |
| WO | WO 99/21523 | 5/1999 |
| WO | WO 99/21526 | 5/1999 |
| WO | WO 03/030189 | 4/2003 |

OTHER PUBLICATIONS

International Search Report for International Application No. PCT/NO2005/000081, dated Jul. 8, 2005.

* cited by examiner

*Primary Examiner*—John P Lacyk
(74) *Attorney, Agent, or Firm*—Patterson & Sheridan, L.L.P.

(57) ABSTRACT

A device for an incubator (1) comprising a platform (6), a ventilation aggregate (12) and a cover (8), wherein the cover (8) comprises a chamber (30) communicating with the ventilation aggregate (12) via at least a first duct (14), and with a patient bed rest (10) of the incubator (1) via flow apertures (32).

15 Claims, 5 Drawing Sheets

INCUBATOR DEVICE

BACKGROUND OF THE INVENTION

1. Field of the Invention

This invention concerns an incubator. More specifically, it concerns an incubator comprising a cover provided with nursing openings, in which the cover partly encloses the patient bed rest of the incubator, and in which ventilation air flows in towards the patient bed rest through flow apertures from a chamber in the cover.

In this context, patient bed rest is meant to imply not only the resting base of the patient, but also the space proximate the patient.

2. Description of the Related Art

When treating premature infants, for example, an incubator commonly is used to best ensure that the infant is provided with an accommodation space in which parameters, such as temperature and air humidity, can be maintained at a suitable level for the infant.

During its stay in the incubator, it is of great importance that the patient can be connected to medical equipment while simultaneously maintaining access to the patient for care and treatment without altering said parameters much.

When using incubators of traditional design, the temperature at the patient bed rest has proven to change significantly when opening the nursing openings. This situation is mainly due to the design of the ventilation system within the incubator, the ventilation air being circulated about the longitudinal axis of the patient. Thus, when opening the nursing openings, ambient air will be drawn into one side of the incubator, and incubator air will emanate from the nursing openings at the opposite side of the incubator. Partly significant temperature differences are also known to exist within incubators of this type, this being due to the ventilation air having an unfavourable flow pattern.

WO 99/21526 pertains to an incubator provided with a dome-shaped cover. Ventilation air is supplied to the patient bed rest via influx apertures distributed in an encircling manner around the patient bed rest. Ventilation air flows via an annulus defined by the cover and ring-shaped screen located at the inside of the cover.

Compared to that of conventional incubators, the incubator according to WO 99/21526 exhibits significantly improved temperature accuracy at the patient bed rest, but at some conditions it may exhibit an unintended flow pattern for the ventilation air at the patient bed rest.

The object of the invention is to remedy or reduce at least one of the disadvantages of prior art.

SUMMARY OF THE INVENTION

The object is achieved in accordance with the invention and by means of the features disclosed in the following description and in the subsequent claims.

A cover partly enclosing the patient bed rest is provided with a chamber through which at least a portion of the inflowing ventilation air flows before flowing through flow apertures and onwards to the patient bed rest.

By arranging the supply duct of the chamber with a suitable shape, a vortex-like rotation may be established in the chamber. Such a rotation, or possibly a turbulent flow in the chamber, ensures a relatively good admixing of any gases or medicines being added to the ventilation air.

According to the invention, the ventilation air emanates most advantageously from the patient bed rest through one or several apertures encircling the patient bed rest.

In order mainly to prevent ambient air from flowing in towards the patient bed rest through the nursing openings of the cover, it has proven advantageous to establish a small overpressure at the patient bed rest.

For example, this overpressure is established by means of a flow restriction for the emanating air. Having established such an overpressure, it is not necessary to be so careful in closing the nursing openings to maintain an even temperature, humidity, gas composition and hygiene in the incubator, which significantly simplifies the work in the incubator.

The inflowing air is adjusted for temperature and humidity in a ventilation battery adjacent to the incubator. The ventilation air flowing into the patient bed rest comprises recycled air mainly, but it is mixed with a part of fresh air to maintain, among other things, a small overpressure at the patient bed rest when the nursing openings are open as described above.

The positions of the nursing openings in the cover are of considerable importance to enable personnel to carry out necessary work without having to remove the cover.

It is known that the body temperature of premature infants assumes the ambient temperature within a short time, this being due to the relatively large skin surface and low thermal capacity of the infant. Thus, supplying colder air by for example removing the cover is unfortunate for the infant. Hence, it is of great importance for the access to the patient via the nursing openings to be as good as possible to avoid removing the cover during normal nursing activities.

In a preferred embodiment, the cover is dome-shaped and provided with five apertures distributed around the perimeter of the cover. Tests have shown that persons about to carry out work in the incubator thus attain a favourable working posture. By arranging the cover rotatable about its vertical axis, access to the patient is improved further, whereby access to areas initially located inside of the cover, and between the access openings, is facilitated significantly.

Alternatively, the nursing opening may be comprised of an opening encircling the cover.

An incubator room in which continuous monitoring of patients takes place, usually is provided with a relatively strong general lighting. This lighting is disturbing to patients that are to sleep. This is a problem especially for premature infants that still may have underdeveloped vision.

Advantageously, the incubator according to the invention may be provided with a light cover that may be pulled across the screen.

Locating a ventilation aggregate of the incubator at a distance from the patient bed rest is advantageous both with respect to the noise and the electromagnetic radiation to which the patient is subjected.

Advantageously, the ventilation aggregate may be placed in a base section of the incubator in such a manner that the patient bed rest may be height-adjusted relative to the floor of the room in which the incubator is placed.

A further advantageous feature of the incubator according to the invention is the ability of the patient bed rest, together with the cover, to be lifted from its base section to a so-called transport incubator provided with a corresponding ventilation aggregate, and without having to disconnect and connect electrical couplings for the ventilation aggregate, for example.

BRIEF DESCRIPTION OF THE DRAWINGS

In the following, a non-limiting example of a preferred embodiment is described and illustrated on the attached drawings, in which.

DETAILED DESCRIPTION

Figure 1:
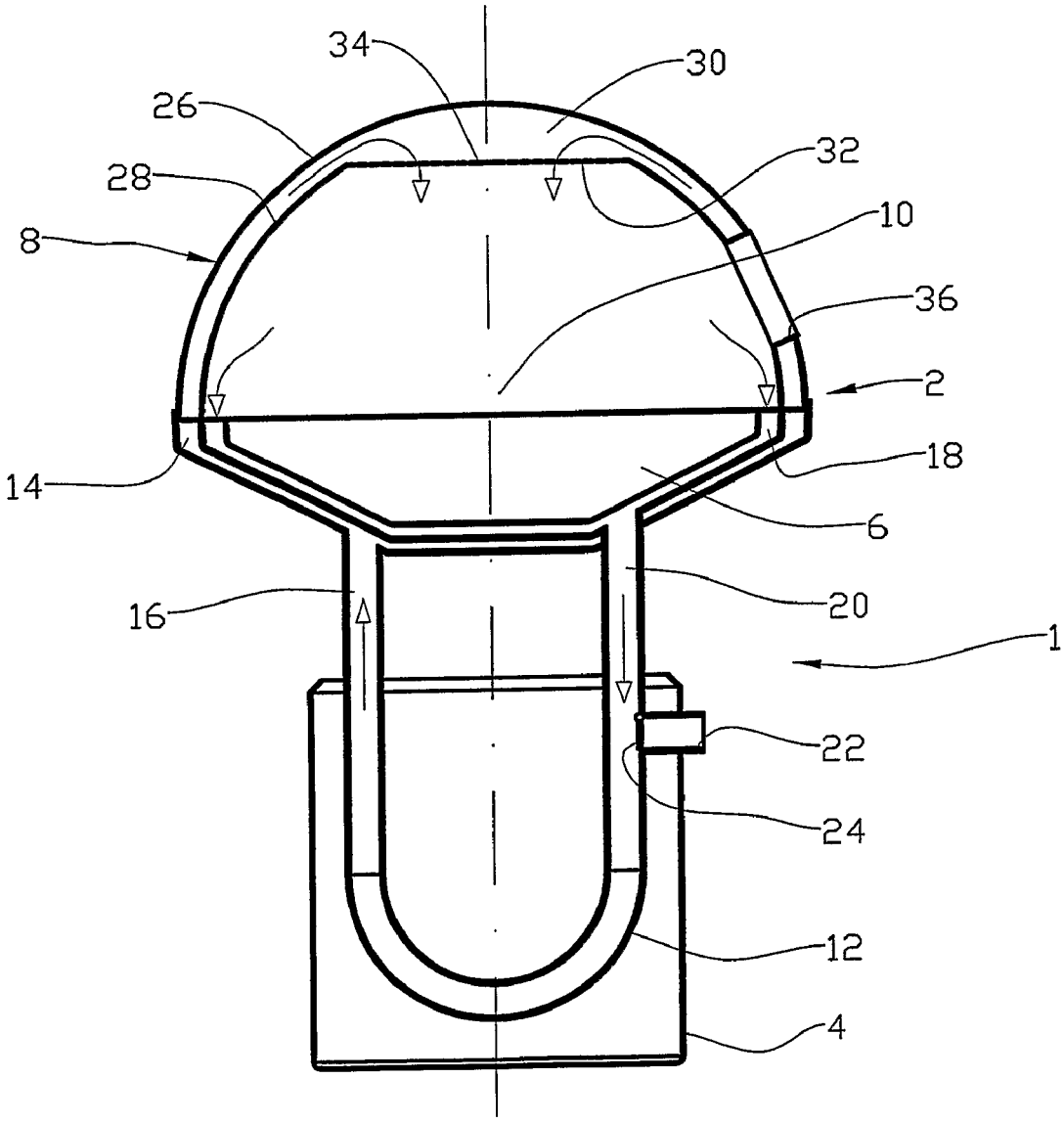
FIG. 1 shows a simplified cross-section of an incubator according to the invention, in which arrows indicate the flow paths of the ventilation air.

On the drawings, reference numeral 1 denotes an incubator comprising an upper section 2 and a base section 4, which preferably may be provided with transport wheels (not shown).

Preferably, the upper section 2 is height-adjustable relative to the base section 4 and comprises a platform 6 and a disconnectable cover 8. A patient bed rest 10 of the incubator 1 is located above the platform 6 and below the cover 8. Thus, the platform 6 and the cover 8 enclose the patient bed rest 10.

In this preferred example of an embodiment, a ventilation aggregate 12 is placed at the base section 4, the aggregate 12 typically comprising the following components (not shown): a fan, a heating element, a humidifier and necessary control equipment.

The platform 6 is provided with a first duct 14 communicating with the ventilation aggregate 12 via a first pipe 16. A second duct 18 communicates with the ventilation aggregate 12 via a second pipe 20. A fresh air supply 22 provided with a control valve 24 is arranged to supply fresh air to the ventilation aggregate 12, the control valve 24 allowing setting of the relative amount of fresh air in proportion to recycled air.

The first duct 14 and the second duct 18 end at the side of the platform 6 facing towards the patient bed rest 10. The second duct 18 is at least formed in a manner allowing ventilation air to flow into the second duct 18 mainly along the entire circumference of the patient bed rest 10.

The cover 8 comprises an outer shell 26 and an inner shell 28. Between the outer shell 26 and the inner shell 28, a chamber 30 is arranged communicating with the first duct 14 in the platform 6.

Figure 2:
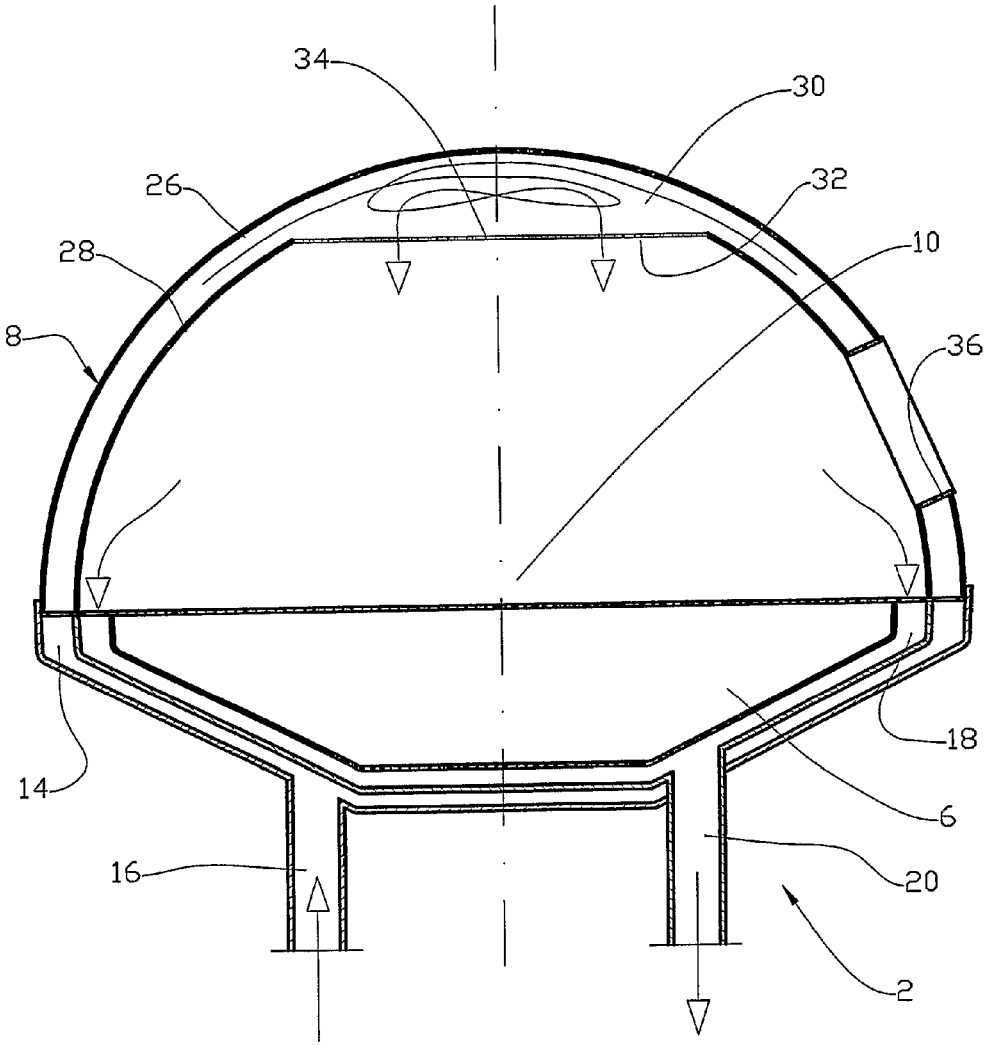
FIG. 2 shows, in larger scale, the upper section of the incubator in cross-section.

The inner duct 28 is provided with through-going flow apertures 32, cf. FIG. 2. On the drawings, the flow apertures 32 are arranged within a planar portion 34 of the inner shell 28. This planar portion 34 represents an advantageous feature, but it is not imperative for the function of the incubator 1.

Figure 4:
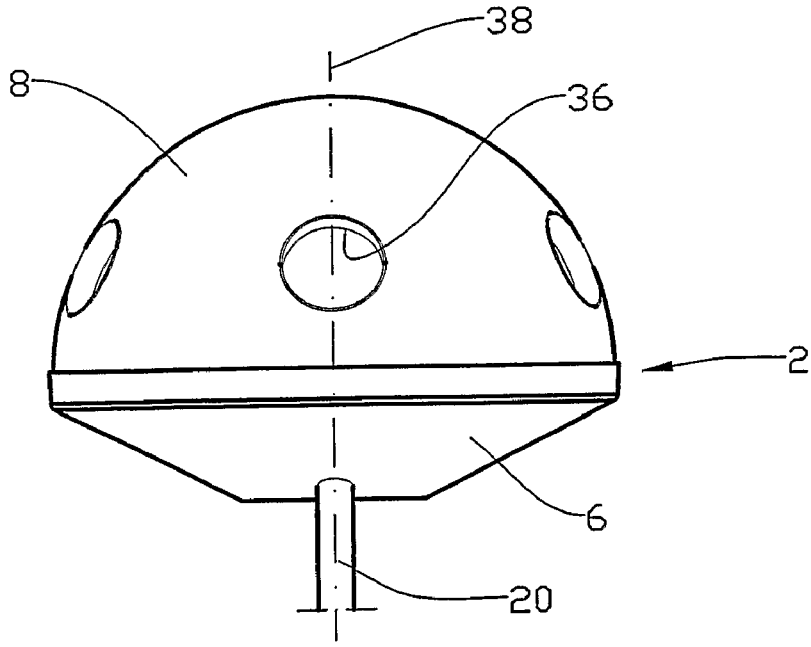
FIG. 4 shows a side elevation of the upper section of the incubator.
Figure 5:
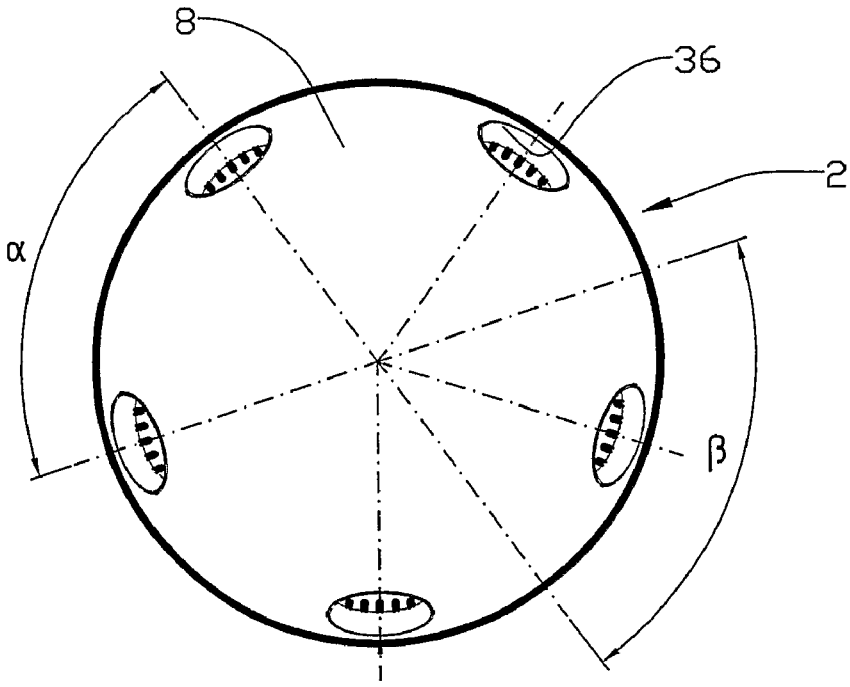
FIG. 5 shows a plan view of the upper section of the incubator.
Figure 6:
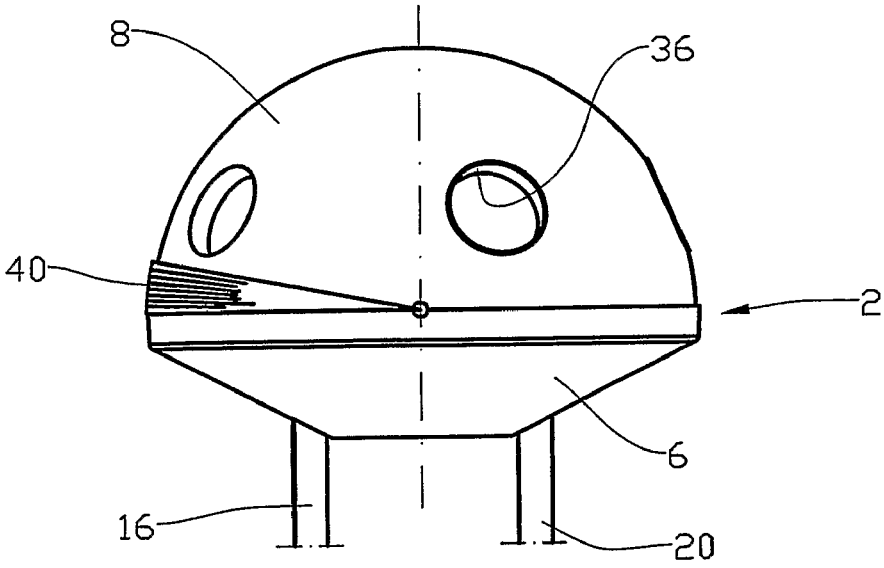
FIG. 6 shows a side elevation of the upper section of the incubator, in which the incubator is provided with a light cover pulled aside.

The cover 8 is provided with five through-going nursing openings 36, cf. FIGS. 2, 4 and 5. The nursing openings 36 extend sealingly through the chamber 30.

The five nursing openings 36 are evenly distributed around the cover 8 at a mutual angle $\alpha$, cf. FIG. 5. The cover 8 is rotatable about its vertical axis 38 at an angle $\beta$ relative to the platform 6, in which the angle $\beta$ most preferably is larger than the angle $\alpha$.

Figure 7:
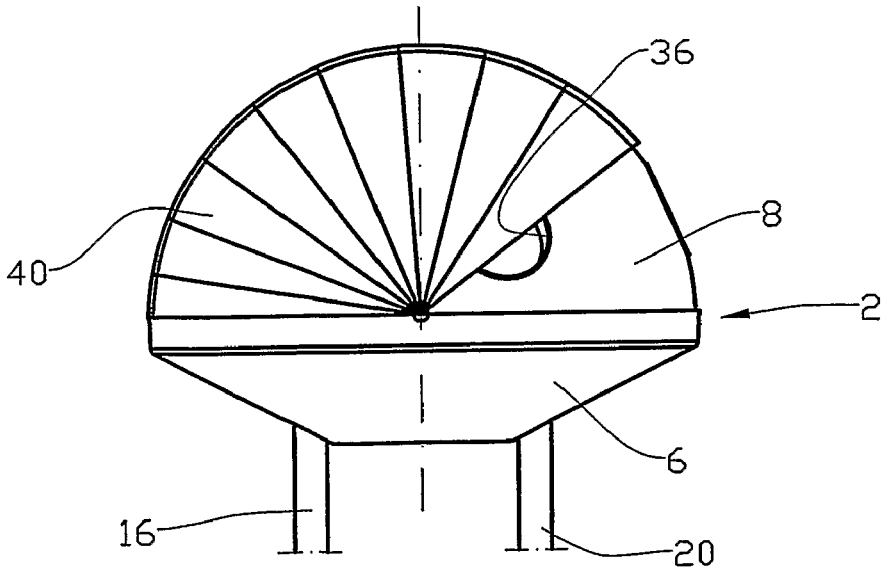
FIG. 7 shows the same as in FIG. 6, but with the light cover partly pulled over.

Preferably, the upper section 2 of the incubator 1 may be provided with a light screen 40. The light screen 40 is connected to the upper section 2 by means of a quick release coupling (not shown) according to known technique per se, and the light screen 40 is arranged to be pulled over the cover 8, as shown in FIG. 7.

Ventilation air flows from the ventilation aggregate 12 via the first pipe 16 and the second duct 14 onwards to the chamber 30, in which the ventilation air may be assigned a vortex-like rotation, alternatively a turbulence, to ensure good mixing of the inflowing ventilation air. The ventilation air then flows through flow apertures towards the patient bed rest 10.

From the patient bed rest 10 the ventilation air flows mainly into the second duct 18 and onwards to the ventilation aggregate 12 via the second pipe 20. Due to the existing overpressure in the cover 8, however, a portion of the ventilation air may emanate through the nursing openings 36.

In order to compensate for the ventilation air emanating from the nursing openings 36, among other things, a portion of fresh air is supplied to the ventilation aggregate 12 via the fresh air supply 22 and the control valve 24.

As mentioned, during work in the incubator 1 the cover 8 may be rotated about its vertical axis 38 to facilitate access to an object (not shown) in the incubator 1.

Figure 3:
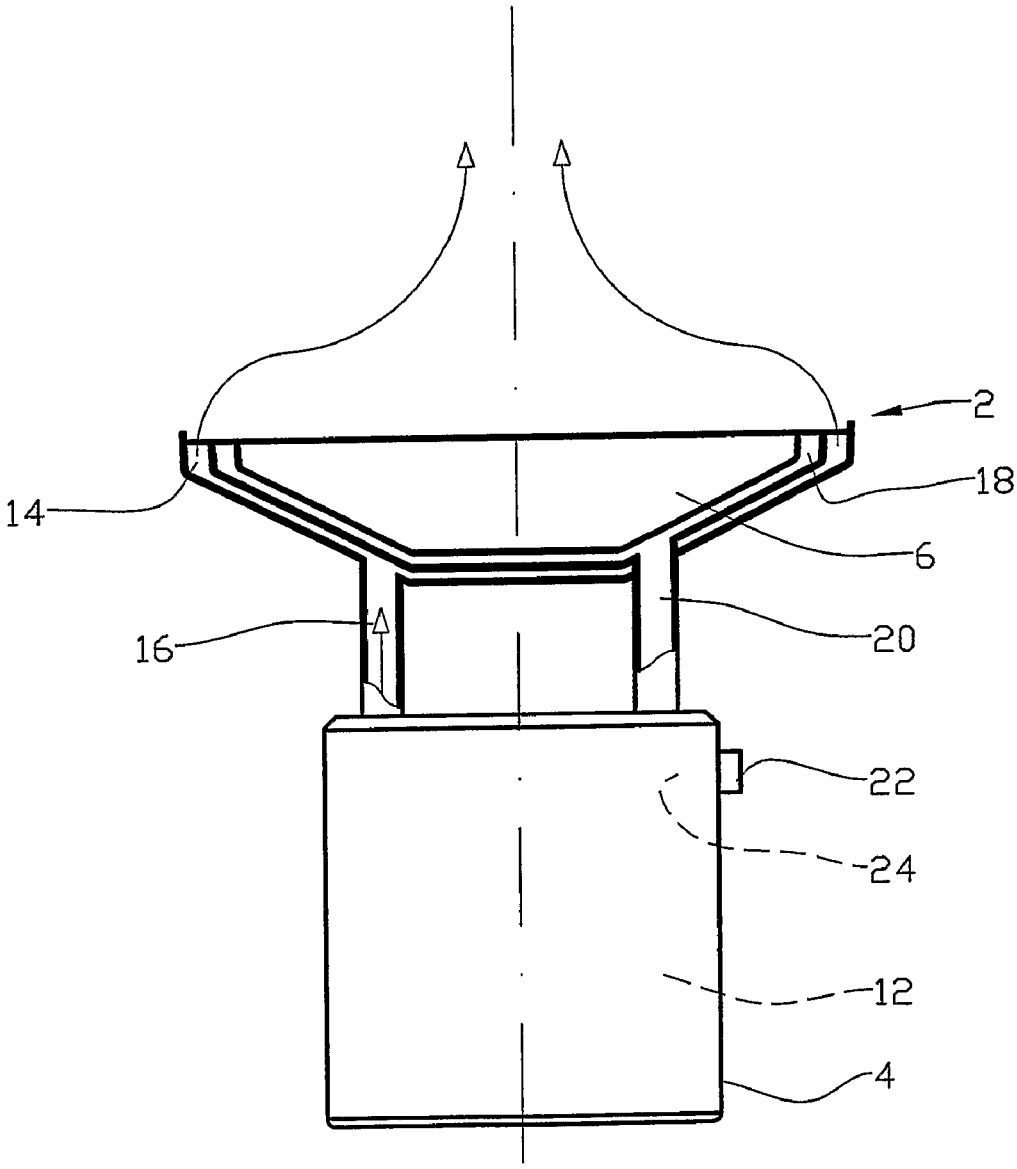
FIG. 3 shows the same as in FIG. 1, but with the cover removed.

If necessary, the cover 8 may be lifted off the platform 6. FIG. 3 shows the incubator 1 without the cover 8.

On the drawings, the platform 6 is shown as a circular embodiment thereof. This embodiment renders possible for the cover 8 to have a semi-spherical shape. Among other things, this semi-spherical shape is favourable with respect to the homogeneity of the air in the incubator 1, thereby substantially avoiding formation of areas wherein deviations in air composition, temperature and humidity may exist. The shape of the platform 6 is not limited to a circular geometry.

The invention claimed is:

1. A device for an incubator, the device comprising:

a platform, a ventilation aggregate, and a cover having an airflow chamber substantially defined between a portion of an outer shell and a planar portion of an inner shell of the cover, wherein the airflow chamber is designed to receive air from the ventilation aggregate's supply side via at least one duct, and wherein the airflow chamber is designed to supply an incubator chamber with air via flow apertures formed in the planar portion of the inner shell, and wherein the incubator chamber is defined between the platform and the cover and the incubator chamber is configured to house a patient bed rest of the incubator and wherein a vortex rotation may be established within the airflow chamber to mix inflowing ventilation air or medicine.

2. The device according to claim 1, wherein between the patient bed rest and the ventilation aggregate, the incubator is provided with a flow restriction arranged to subject the patient bed rest to an overpressure relative to an ambient atmosphere.

3. The device according to claim 1, wherein the ventilation aggregate communicates with a fresh air supply.

4. The device according to claim 3, wherein the fresh air supply is provided with a control valve.

5. The device according to claim 1, wherein the platform is circular.

6. The device according to claim 1, wherein the cover is rotatable about its own vertical axis relative to the platform.

7. The device according to claim 5, wherein the cover has at least five nursing openings.

8. The device according to claim 1, wherein the airflow chamber is located above the incubator chamber.

9. An incubator device comprising:

a cover having an outer shell and an inner shell, the shells define an airflow chamber between a portion of the outer shell and a planar portion of the inner shell, wherein the airflow chamber is configured such that a turbulent flow is created within the airflow chamber to mix inflowing ventilation air or medicine with airflow in the airflow chamber;

a platform, wherein the inner shell of the cover and the platform define a chamber that is configured to receive a bed rest; and a ventilation aggregate for circulating airflow through the chamber, wherein the airflow enters an upper portion of the chamber from the airflow chamber via a plurality of apertures in the planar portion of the inner shell and exits a lower portion of the chamber adjacent the bed rest.

10. The incubator device of claim 9, further comprising a supply duct in communication with the ventilation aggregate, wherein the supply duct is connected to the airflow chamber via a passageway defined between the outer shell and the inner shell.

11. The incubator device of claim 9, further comprising a return duct positioned adjacent the bed rest, wherein the return duct is in communication with the ventilation aggregate.

12. The device according to claim 9, further comprising a flow restriction between the bed rest and the ventilation aggregate, wherein the flow restriction is configured to subject the bed rest to an overpressure relative to an ambient atmosphere.

13. An incubator device comprising:

a cover having an airflow chamber disposed between a portion of an outer shell and a planar portion of an inner shell of the cover;

a platform for supporting a bed rest;

a incubator chamber defined between the cover and the platform, wherein the airflow chamber is positioned above the incubator chamber; and a ventilation aggregate configured to circulate airflow through the incubator chamber, the ventilation aggregate includes a supply duct connected to the airflow chamber to supply airflow to an upper portion of the incubator chamber via a plurality of apertures formed in the planar portion of the inner shell and a return duct positioned adjacent the bed rest to remove airflow from a lower portion of the incubator chamber, wherein a vortex rotation may be established within the airflow chamber to ensure admixing of any gases or medicines being added to airflow.

14. The device according to claim 13, further comprising a flow restriction between the bed rest and the ventilation aggregate, wherein the flow restriction is configured to subject the bed rest to an overpressure relative to an ambient atmosphere.

15. The device according to claim 1, wherein the airflow chamber is configured such that a turbulent flow is created within the airflow chamber to mix inflowing ventilation air or medicine.

* * * * *